United States Patent [19]

Gaffney

[11] 4,382,510

[45] May 10, 1983

[54] ROLL DISPENSING CONTAINER

[75] Inventor: William Gaffney, New York, N.Y.

[73] Assignee: Gafcel Industries, Inc., Bronx, N.Y.

[21] Appl. No.: 312,836

[22] Filed: Oct. 19, 1981

[51] Int. Cl.[3] ..... B65D 85/67; B65D 85/671; B65D 5/72

[52] U.S. Cl. ..... 206/396; 206/408; 206/409; 229/41 C; 229/52 B

[58] Field of Search ..... 206/396, 394, 395, 389, 206/409, 408; 229/41 C, 52 B

[56] References Cited

U.S. PATENT DOCUMENTS

| | | | |
|---|---|---|---|
| 1,973,237 | 9/1934 | Vilas | 206/409 |
| 2,000,210 | 5/1934 | Bayless | 229/41 C |
| 2,312,598 | 3/1943 | Sprague | 229/52 B |
| 2,386,062 | 10/1945 | Roehrl . | |
| 2,674,400 | 4/1954 | Ross | 229/37 |
| 2,674,400 | 4/1954 | Ross | 206/395 |
| 2,706,592 | 4/1955 | Schaller | 229/23 |
| 2,713,938 | 7/1955 | Snyder . | |
| 2,724,538 | 11/1955 | Schweich | 206/397 |
| 2,812,854 | 11/1957 | Fletcher . | |
| 2,860,773 | 11/1958 | Zackheim | 206/394 |
| 2,974,850 | 3/1961 | Mayer | 229/37 |
| 3,059,763 | 10/1962 | Eifrid | 242/77.3 |
| 3,128,025 | 4/1964 | Buttery et al. | 206/395 |
| 3,229,812 | 1/1966 | Metzger | 206/396 |
| 3,338,399 | 8/1967 | Burt . | |
| 4,244,254 | 1/1981 | Fish | 206/395 |
| 4,260,100 | 4/1981 | Hoffman | 229/41 C |

*Primary Examiner*—William T. Dixson, Jr.
*Attorney, Agent, or Firm*—Kirschstein, Kirschstein, Ottinger & Cobrin

[57] ABSTRACT

A roll dispensing container which is used for storing an elongated web of thermoplastic material comprising plural laminae which define a multiplicity of gas-filled bubbles.. The container is constructed in a manner that permits easy measured dispensal of the web therefrom. The roll dispensing container is easily assembled from a corrugated-board blank and when fully assembled is dimensioned so as to be capable of being shipped from place to place relatively inexpensively.

5 Claims, 5 Drawing Figures

ROLL DISPENSING CONTAINER

BACKGROUND OF THE INVENTION

1. Field of the Invention

This invention relates to a container for dispensing an elongated web composed of plural thermoplastic laminae mutually defining a multiplicity of gas-filled bubbles. The web is coiled about an axis transverse its length such that a generally cylindrical void is located at the center of the coiled web. The container is of a one-piece construction and includes trunnions as an integral part thereof.

2. Description of the Prior Art

Containers for dispensing many different types of materials, which are coiled about themselves in a manner so that there is a void located in the center of the coiled material, are known in the art. Some examples of this type of container are: the containers in which aluminum foil are sold; the containers in which cellophane tape is sold, etc.

When the material contained in the dispensing container is bulky, it is usually necessary to have at least one trunnion for use with the container. The trunnion extends into the cylindrical void, in order to allow easy and proper dispensing of the material within the container.

The inclusion of a separate trunnion has heretofore created problems. The separate trunnions give rise to an extra manufacturing expense. Further, difficulties with inventory have arisen due to the need for inclusion of a separate trunnion.

A further problem that has occured when packaging bulky goods in a dispensing container is that the cost of shipping said goods in the container is high due to the generally large dimensions of the shipping container.

Difficulties also arise in storing big containers, prior to filling them with the material to be dispensed therefrom.

SUMMARY OF THE INVENTION

1. Objects of the Invention

It is an object of this invention to provide a roll dispensing container which is not subject to the drawbacks of the prior art containers.

It is another object of this invention to provide a roll dispensing container, which contains a pair of trunnions that are an integral part of the container.

It is still a further object of this invention to provide a roll dispensing container which is capable of being stored flat before any material is placed therein.

Another object of this invention is to provide a roll dispensing container which is of a shape and dimension such that it can be inexpensively shipped from place to place.

Still another object of this invention is to provide a roll dispensing container which is inexpensive to manufacture and is of a one-piece construction.

Yet another object of this invention is to provide a roll dispensing container which can be quickly and easily assembled from a blank.

Other objects of this invention in part will be obvious and in part will be pointed out hereinafter.

2. Brief Description of the Invention

In keeping with these objects and others which will become apparent hereinafter, one feature of this invention resides, briefly stated, in a roll dispensing container for dispensing an elongated web composed of plural plastic laminae mutually defining a multiplicity of gas-filled bubbles. The web is coiled about an axis transverse its length such that a generally cylindrical void is located in the center of the coiled web. The container includes a receptacle which has a ring of at least eight equi-dimensioned rectangular corrugated-board segments forming a peripheral side and two equi-dimensioned polygonal corrugated-board top and bottom segments, each polygonal segment having as many sides as there are rectangular segments. The receptacle further contains sundry tabs and grooves for attaching the rectangular segments and polygonal segments to one another, the entire receptacle being a single one-piece unit.

One of the rectangular segments includes a slot which is dimensioned and shaped to permit the web to be pulled therethrough by a user.

Additional tabs in one-piece with the receptacle form a pair of registered trunnions centered on the opposite inner faces of the polygonal segments. The registered trunnions extend into the aforementioned cylindrical void and allow the coiled web to be easily dispensed.

The container is dimensioned and shaped so that it may be inexpensively shipped by common carriers. To this end, the combined measurements of the height and the circumference of the container do not exceed 84 inches.

The container, as heretofore described, is easily assembled from a flat, corrugated-board blank. The flat corrugated-board blank is constructed to include a plurality of slots and a plurality of bendable joint portions. Additionally, the flat blank is provided with a plurality of integral tabs and grooves. The afore-described blank may be quickly assembled into the afore-described container and hence, a manufacturer can efficiently store the flat blanks and, as needed, assemble said flat blanks to form containers usable for dispensing elongated webs.

DETAILED DESCRIPTION OF THE PREFERRED EMBODIMENTS

Figure 2:
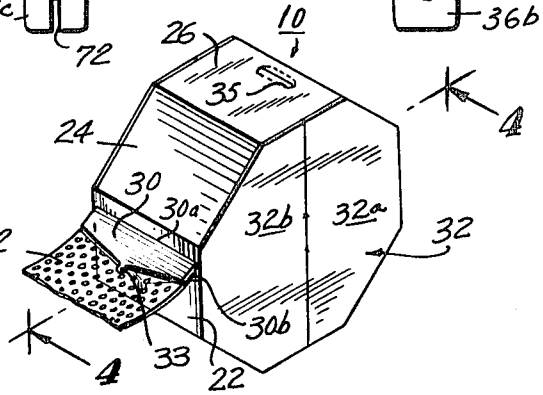
FIG. 2 is a perspective view of the roll dispensing container of this invention with the elongated web of material therein.
Figure 5:
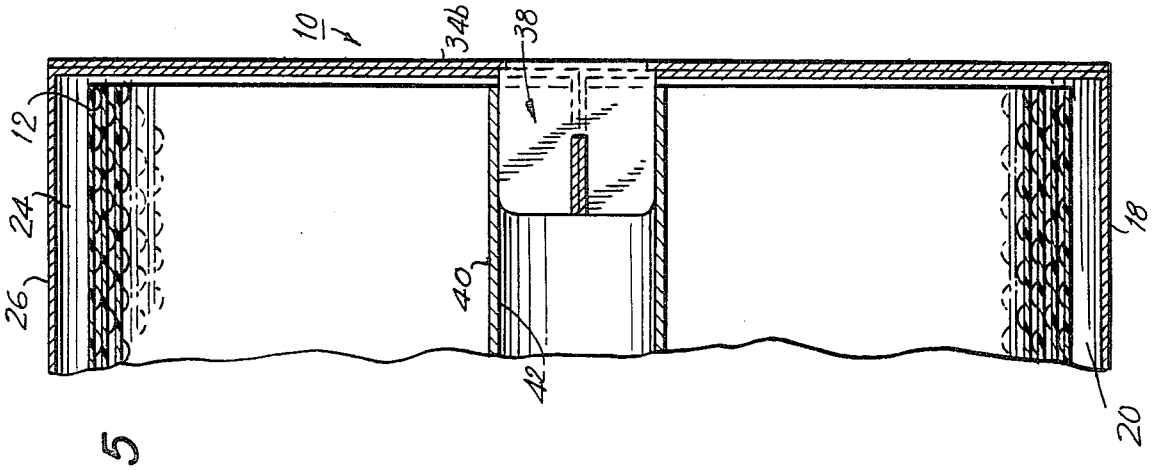
FIG. 5 is a sectional view taken substantially along line 5—5 of FIG. 4.
Figure 4:
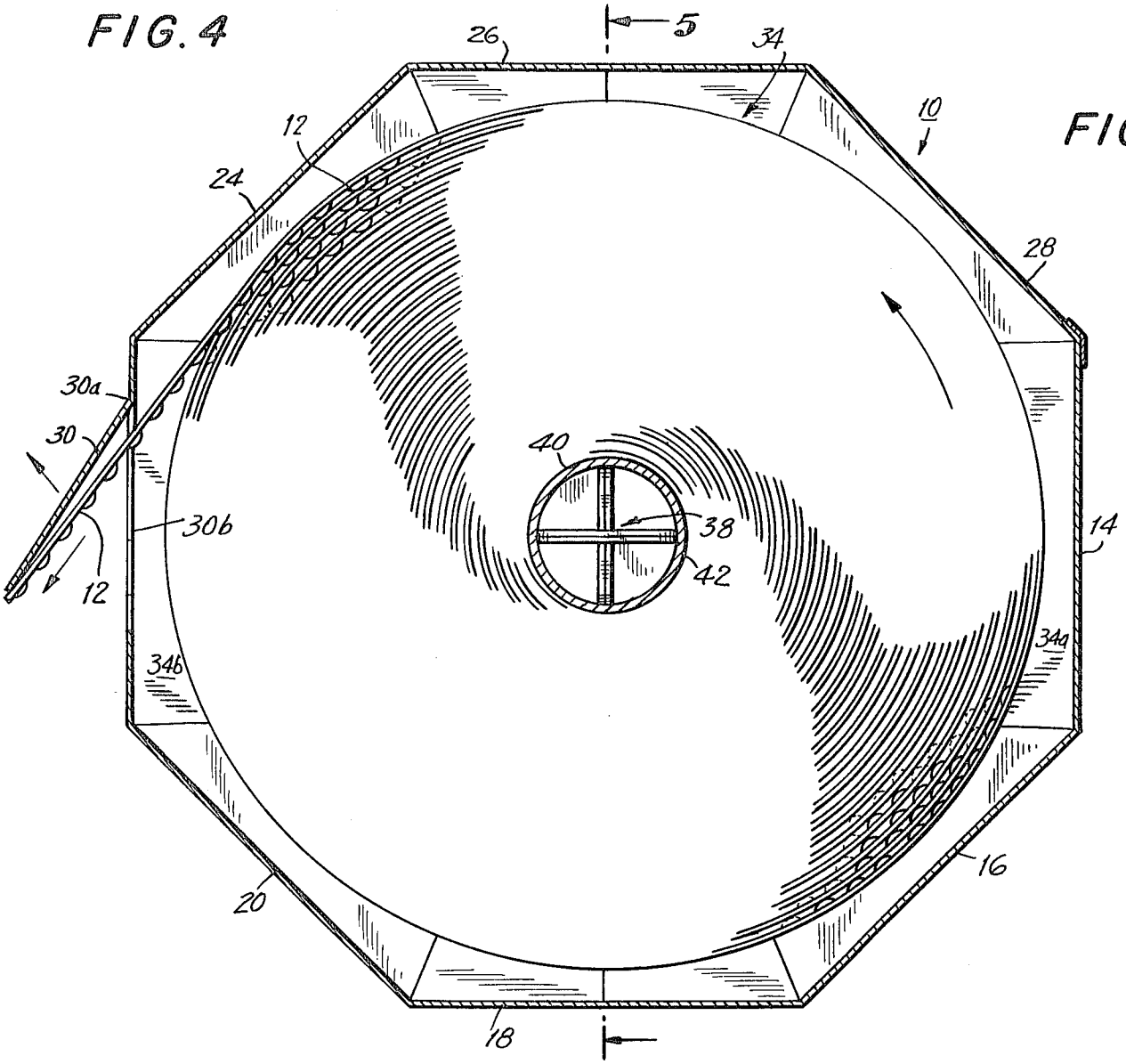
FIG. 4 is an enlarged sectional view taken substantially along line 4—4 of FIG. 2.

Referring now in detail to the drawings, and more particularly to FIG. 2, the reference numeral 10 denotes the roll dispensing container of the present invention. In accordance with this invention, container 10 has therein a coiled elongated web 12 composed of plural thermoplastic laminae mutually defining a multiplicity of gas-filled bubbles. An example of this type of material is described in U.S. Pat. No. 4,184,904.

Although it is contemplated that in a preferred embodiment container 10 will enclose the afore-described coiled web 12, it is possible to use container 10 for dispensing any other appropriate type of web material.

Container 10 may be made of any appropriate material. Since it is desirable for the container to be both lightweight and sturdy, in a preferred embodiment container 10 is made of double-faced (note drawing at the right side of FIG. 2.) corrugated board.

Container 10 may have its exterior surface printed or labelled or it may be left plain. It is generally desirable to utilize the numerous surfaces of the container to best advantage by including printing thereon. In a preferred embodiment, the printing includes the name of the manufacturer of the web; the dimensions of the web; and instructions concerning how best to dispense the web 12 from container 10.

In a preferred embodiment, the container 10, when fully assembled includes a ring composed of eight equi-dimensioned generally rectangular segments 14, 16, 18, 20, 22, 24, 26, 28. One of said rectangular segments, as depicted in the drawings, segment 22, has a flap portion 30 thereon.

Flap portion 30 is attached to polygonal segment 22 by a transverse hinge 30*a* and a weakened serrated transverse edge 31 spaced from the hinge. Flap portion 30 is capable of assuming three positions. The first position is one in which flap portion 30 is fully attached to and coplanar with polygonal segment 22. Said first position, which is the initial position of flap 30 is a limited time-existence position, that is to say once flap portion 30 is moved out of said first position, it cannot be returned thereto. The second position is a partially open position in which the weak attachment of serrated edge to segment 22 has been broken by a user but the flap portion still remains coplanar with segment 22 so that the web cannot be pulled therethrough. The third position is a fully open position in which the flap portion 30 has been bent upwardly and outwardly away from segment 22 forming a dispensing slot 30*b* (see FIG. 2) such that the web can be pulled therethrough. Flap portion 30 may be reciprocally moved from said second position to said third position by a user as desired.

Flap portion 30 has thereon, projecting from the edge 31, a tab portion 33 which is at the center of the edge 31. In order to move flap portion 30 out of its first position a user must push in tab portion 33 and lift flap portion 30 from segment 22 along the line of the weakened serrated edge 31.

Another of the rectangular segments, e.g. segment 26, is formed with an elongated ovoid hole 35 therein. Said elongated ovoid hole 35 is dimensioned and shaped such that a person may easily insert his fingers therethrough and hence hole 35 serves as a carrying adjunct so that a user may easily move container 10 from place to place.

Slot 30*b* is dimensioned and shaped to permit a user to easily pull web 12 therethrough.

The container has two polygonal top and bottom panels 32 and 34. Each polygonal panel has a number of sides equal to the number of ring segments. Each polygonal panel is composed of two identical polygonal half panels 32*a* and 32*b*, 34*a* and 34*b*.

The equi-dimensioned rectangular segments 14, 16, 18, 20, 22, 24, 26, 28 form a ring defining a peripheral side of the container 10 and the two polygonal panels constitute the top and bottom of the container.

The container has two registered trunnions 36 and 38. Trunnions 36 and 38 are centered on and extend inwardly from opposite inner faces of the top and bottom panels 32 and 34.

Figure 3:
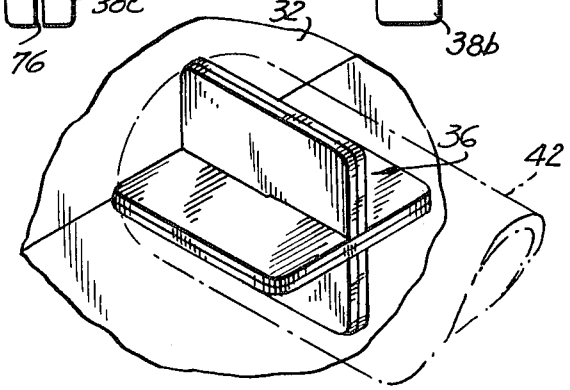
FIG. 3 is an enlarged perspective view of one of the trunnions of the roll dispensing container with the first loop of the web of material shown coiled about a tube therein in phantom.

The elongated web 12 of thermoplastic laminae mutually defining a multiplicity of gas-filled bubbles is coiled about an axis transverse its length as best seen in FIG. 3. The web 12 is coiled in a manner such that a generally cylindrical void 40 is located in the center of the coiled web.

Preferably, the web is coiled about a hollow cardboard tube 42, the cardboard tube having a length slightly greater than the width of the elongated web. It is possible to properly coil the web without using tube 42 but the use of tube 42 makes the coiling easier, prevents deformation of the web, and aids in dispensal of the web from the container 10. The ends of the tube project from the ends of the coiled web.

Trunnions 36 and 38 are dimensioned such that they can be easily inserted into the tube 42 or in the alternative into the void 40 with a slight amount of frictional engagement such that the trunnions will not readily slip out of the tube after they have been inserted therein. When the container 10 is fully assembled and the web placed therein, each trunnion extends about four inches into the tube or void from opposite sides thereof.

Container 10 is designed such that when its height measurement (between polygonal panels 32, 34) is added to its circumferential measurement, the combined dimensions are not in excess of eighty-four inches. By keeping the combined dimensions no greater than eighty-four inches, container 10 can be shipped via United Parcel Service, at cheaper rates than larger prior art containers used for containing the same type and amount of material. By constructing container 10 such that it has an eight-segment peripheral side, it is possible to keep the combined measurements of the container such that they do not exceed eight-four inches.

Figure 1:
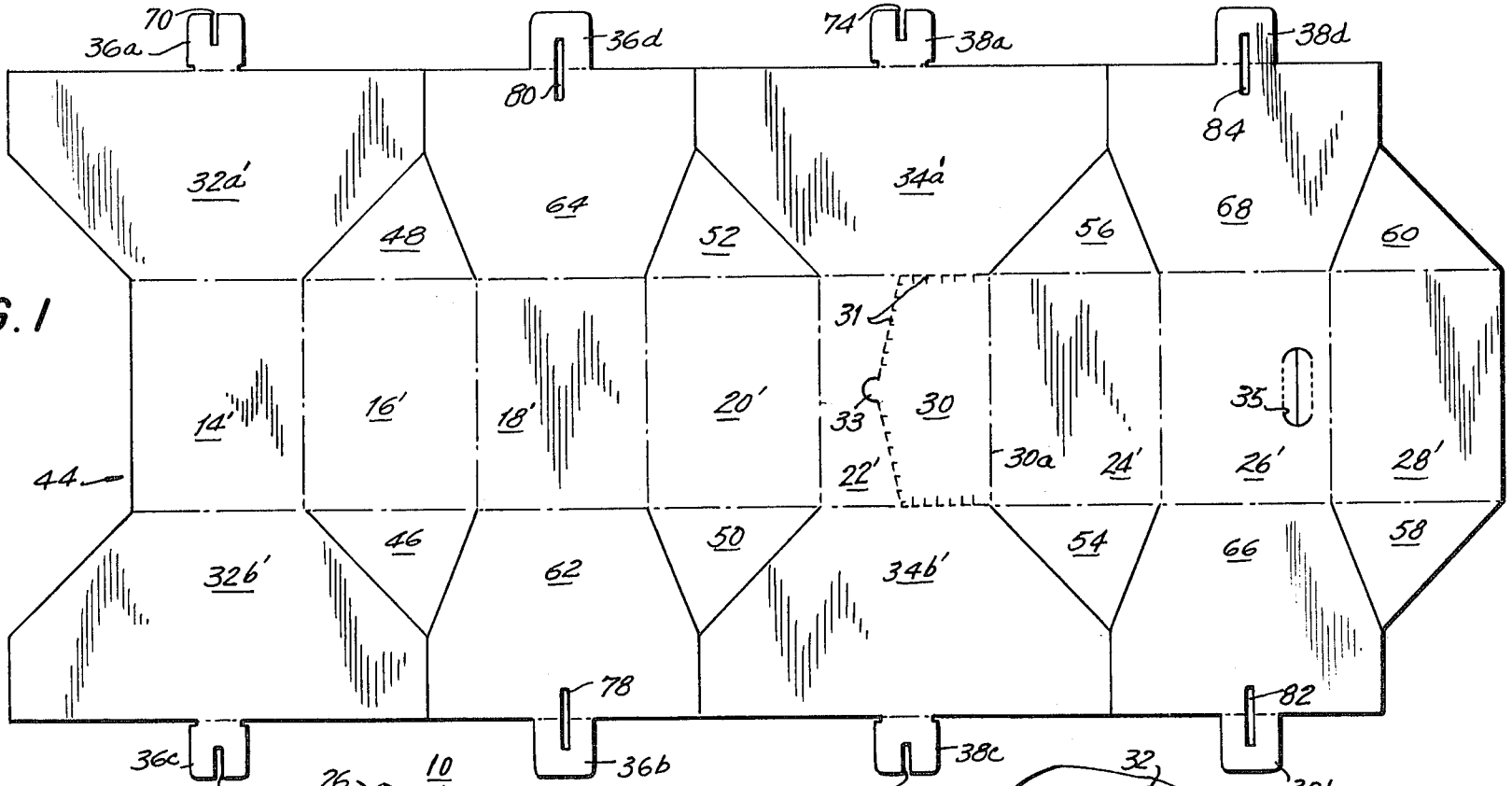
FIG. 1 is a plan view of the blank of this invention prior to being assembled into a roll dispensing container.

In a preferred embodiment, the container 10 is assembled from a flat corrugated-board blank 44, best seen in FIG. 1. Due to the fact that blank 44 is flat, it is easily stored. Blank 44 may be quickly assembled to form the container 10 as the need for containers arises.

Corrugated-board blank 44 is formed with a line of crease-connected eight equi-dimensioned rectangular segments 14′, 16′, 18′, 20°, 22′, 24′, 26′, 28′ which is the fully assembled container 10 are the rectangular segments 14, 16, 18, 20, 22, 24, 26, 28.

On each side of four alternate rectangular segments of the blank 16′, 20′, 24′, 28′ there is a triangular gore. Thus there are eight such triangular gores 46, 48, 50, 52, 54, 56, 58, 60. The blank 44, and the container assembled therefrom, may be formed without these triangular gores, but inclusion of the gores adds extra strength to the assembled container.

On each side of the remaining rectangular segments 14′, 18′, 22′, 26′ there is a six-sided segment totalling eight, six-sided segments. Four of said six-sided segments, half panels 32*a*′, 32*b*′, 34*a*′, 34*b*′ form the two polygonal panels 32 and 34 of the fully assembled box. The other four, six-sided segments 62, 64, 66, 68 provide the fully assembled container with additional strength.

Extending from the middles of the free edges of half panels 32*a*′, 32*b*′, 34*a*′ and 34*b*′ are tabs 36*a*, 36*c*, 38*a*, 38*a*, 38*c* containing central open-ended slots 70, 72, 74, 76 therein. Extending from the middles of the free edges of segments 62, 64, 66, and 68 are tabs 36*b*, 36*d*, 38*b*, 38*d* with central closed-ended grooves 78, 80, 82, 84 therein. The closed-ended grooves extend from the tabs into the associated six-sided polygonal segments 62, 64, 66, 68. Tabs 36*a*, 36*b*, 36*c*, 36*d*, 38*a*, 38*b*, 38*c*, 38*d* not only provide a method for assembling container 10 but further form the trunnions 36, 38 of the fully assembled container 10.

Certain of the aforementioned adjacent segments are formed by cuts shown in FIG. 1 as solid black lines.

Other adjacent segments of the blank are connected to one another by weakened foldable hinge portions (crease lines) in the corrugated board which are shown in FIG. 1 as broken lines. The blank 44 with all the aforementioned segments constitutes a single piece as does the fully assembled (erected) container 10.

In keeping with the invention, it is preferable to first assemble one-half of the container 10 such that one polygonal panel (two adjoining half panels) with its associated trunnion is fully assembled, as is part of the eight-sided ring periphery. The rolled web 12 is then placed in the partially assembled container such that that one fully assembled trunnion extends into the void. The container is thereupon assembled or closed around the rolled web and the other fully assembled trunnion is inserted into the void of the other end of the web.

Specifically, to assemble the container of this invention from the blank 44, a user first folds rectangular segment 14' to a position at 45° to segment 16' and then segment 16' at 45° to segment 18' to start the formation of the ring. Next, the user folds segment 62 to a position 90° to segments 14', 16' and 18'. Now, gore 46 is folded to overlie segment 62 and segment **32*b'* is folded to overlie gore 46 so that gore 46 is sandwiched between segments 32*b'* and 62. Next, tab 36*a* is folded to a position perpendicular to segment 32*b'* and tab 36*b* is folded to a position perpendicular to segment 62. Thereupon tab 36*a* is inserted through groove 78 of tab 36*b* so that it will be at 90° to segments 62 and 32*b'* and to tab 36*b*. Segment 20' is now folded to a position in which it is 45° to segment 18' and gore 50 is folded to overlie segment 62. Segment 34*b'* is folded to overlie gore 50 which thus is sandwiched between segments 34*b'* and 62. Segment 34*b'* is accordingly coplanar with segment 32*b'*. Tab 36*c*, similarly to tab 36*a*, is inserted through groove 78 of tab 36*c*, said tabs 36*a* and 36*c* being juxtaposed. Segments 22' and 24' are lifted upwardly, and segment 66 is moved inwardly of the partially folded container. Gore segment 54 is folded such that it is between segments 66 and 34*b* and tabs 36*a* and 36*c* are inserted through grooves 82 of tab 36*d*. Tabs 36*b* and 36*d* are juxtaposed, forming a mutual slot for reception of the tabs 36*a* and 36*c* to provide the trunnion 36 and to lock up one side of the container. Coplanar segments 32*b'* and 34*b'* form a side of the container from the center of which the trunnion 36 extends perpendicularly. At this point, the rolled web 12 is inserted with the trunnion 36 formed from tab segments 36*a*, 36*b*, 36*c* and 36*d* extending within one end of the void. After the web is so inserted, the opposite side of the container is folded in a manner similar to the manner heretofore detailed for folding the first side of the container. The folding of the second side results in tab segments 38*a*, 38*b*, 38*c* and 38*d* forming the trunnion 38 which is positioned to extend into the other side of the cylindrical void of the web. In this manner, the container is fully assembled with the web contained therein. The adjoining free ends of segments 14', 28'** are taped together, as are all non-hinged edges of the container and the adjacent free edges of the half segments.

Trunnions 36 and 38 extending into the void 40 or the tube 42 rotatably support the coiled web 12 and make it possible for the user to easily dispense said coiled web from the container.

By forming the blank 44 such that the trunnions 36, 38 are created in the processes of assembling the container, the need for separate trunnions that must be attached to the container is avoided. This saves a good deal of money and time. It also minimizes problems caused by a non-integral trunnion slipping off of the container to which it is attached.

The web 12 is formed with transverse serrations at regular intervals. In a preferred embodiment, the web 12 is serrated every twelve inches. This serration of the web aids a user in severing from the coiled web 12 the amount of said web that he desires to use, after pulling out said desired amount of web through dispensing slots **30*b***.

It will be understood that each of the elements described above, or two or more together, may also find a useful application in other types of constructions differing from the types described above.

While the invention has been illustrated and described as embodied in a roll dispensing container, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

Having thus described the invention, there is claimed as new and desired to be secured by Letters Patent:

1. A one-piece container for dispensing an elongated web composed of plural thermoplastic laminae mutually defining a multiplicity of gas-filled bubbles, said web being coiled about an axis transverse to its length to form a central cylindrical void, said container comprising a receptacle including:

(A) a ring of at least eight equi-dimensional retangular corrugated-board segments successively joined to one another to form a peripheral side, (B) two equi-dimensioned polygonal corrugated-board segments, (i) each polygonal segment having as many sides as there are rectangular segments, (ii) each polygonal segment being plane, (iii) the two polygonal segments being parallel to each other, (iv) the two polygonal segments being perpendicular to the rectangular segments, (v) each of the two polygonal segments being formed of two equal half-segments, (vi) each polygonal half-segment being joined by an integral hinge to a different rectangular segment so as to permit the two associated half-segments of a given polygonal segment to be folded to form a single polygonal segment which lies at the edges of one set of edges of the ring of rectangular segments, (C) some of the edges of the rectangular segments to which the polygonal half-segments are not hinged having hinged thereto six-sided segments of a shape resembling the polygonal half-segments but narrower than the same, (i) all of the narrower six-sided segments and the polygonal half-segments of the container being in-folded to extend over the otherwise-open sides of the ring, (D) each of the narrower six-sided segments and each of the polygonal six-sided half-segments having a free edge remote from the hinged edge thereof, (E) means providing tabs at the centers of the free edges of the narrower six-sided segments and the polygonal half-segments, (i) all of said tabs being hinged to their associated segments, (ii) all of said tabs being in-folded to extend into the container and being interlocked so as to be inter-engaged and thereby form registered trunnions that extend from the inner faces of the parallel plane polygonal segments toward the interior of the container and into the generally cylindrical void, (F) said trunnions rotatably supporting the coiled web in the container for rolling dispensal thereof, (G) said container further including a slot formed in one of said rectangular segments which is dimensioned and shaped to permit the web to be pulled therethrough by a user.

2. The one-piece roll dispersing container of claim 1, wherein there are eight equi-dimensioned rectangular segments and wherein each polygonal segment has eight sides.

3. The one-piece roll dispensing container of claim 2, wherein the combined measurement of the eight-part peripheral ring plus the height of a polygonal side is not greater than eighty-four inches.

4. A flat corrugated-board blank usable to form the one-piece roll dispensing container of claim 2 comprising eight equi-dimensioned rectangular segments arranged in a line and foldable to form the eight-part peripheral side of the container, four alternate ones of the rectangular segments of the blank having six-sided segments on each side thereof which are half-octagons and foldable to form the two eight-sided polygonal segments of the container, the remaining rectangular segments having narrower six-sided segments otherwise similar in size to the polygonal half-segments, each six-sided segment having a central tab portion extending from a free edge thereof, four of the tab portions having an open-ended slot therein, a different four of the tab portions having a close-ended groove therein, the tabs with the open-ended slots and the tabs with the close-ended grooves alternating with one another, the tabs being such that operatively attached to each of the said four rectangular segments are either two slots or two grooves, the tabs being foldable and interlockable to form the trunnions of the container, and the blank including foldable hinges and cut areas along which the tab portions and segments can be folded and bent to form the one-piece container.

5. The blank of claim 4, and additionally comprising eight triangular gore segments, the triangular gore segments being attached on each side of each rectangular segment that has no attached six-sided segment.

* * * * *